United States Patent [19]

Salmon et al.

[11] 4,433,454

[45] Feb. 28, 1984

[54] SAW TYPE GIN STAND WITH SEED REMOVAL TUBE

[75] Inventors: Joe E. Salmon, Birmingham; Fleetwood E. Strother; James R. Crawford, both of Prattville, all of Ala.

[73] Assignee: Allied Products Corporation, Chicago, Ill.

[21] Appl. No.: 293,091

[22] Filed: Aug. 17, 1981

Related U.S. Application Data

[63] Continuation of Ser. No. 68,101, Aug. 20, 1979, abandoned.

[51] Int. Cl.[3] ..... D01B 1/08

[52] U.S. Cl. ..... 19/55 R

[58] Field of Search ..... 19/55 R–64.5

[56] References Cited

U.S. PATENT DOCUMENTS

| | | | |
|---|---|---|---|
| 26,516 | 12/1859 | Olmstead | 19/55 B |
| 1,341,168 | 5/1920 | Cotton | 19/55 R |
| 2,149,669 | 3/1939 | Cumpston | 19/55 R |
| 2,743,484 | 5/1956 | Raynor | 19/56 |
| 2,834,057 | 5/1958 | Raynor | 19/55 R |
| 3,091,001 | 5/1963 | Pease et al. | 19/55 R |
| 3,135,021 | 6/1964 | Jennings | 19/56 |
| 4,313,242 | 2/1982 | Salmon | 19/55 R |

*Primary Examiner*—Louis Rimrodt

*Attorney, Agent, or Firm*—Mason, Fenwick & Lawrence

[57] ABSTRACT

A high capacity saw type cotton gin having the usual ginning ribs, hulling ribs, and saw cylinder, and structure defining a roll box generally above the intervening zone between the ginning and hulling ribs having an entrance at the top of the intervening zone to receive cotton carried through the hulling ribs, wherein a rotatable perforated seed removal tube is located at the interior portion of the seed roll formed in the roll box near its axis of rotation having many peforations sized to pass ginned seeds therethrough into its interior while preventing passage of unginned seeds. The seed removal tube is continuously rotated in a direction corresponding to the direction of seed roll rotation and at a surface speed significantly exceeding the speed imparted to the immediately confronting seed roll portions by the saws, and screw conveyor structure as provided within the tube rotated to convey the ginned seeds in the tube outwardly through end portions of the tube.

14 Claims, 5 Drawing Figures

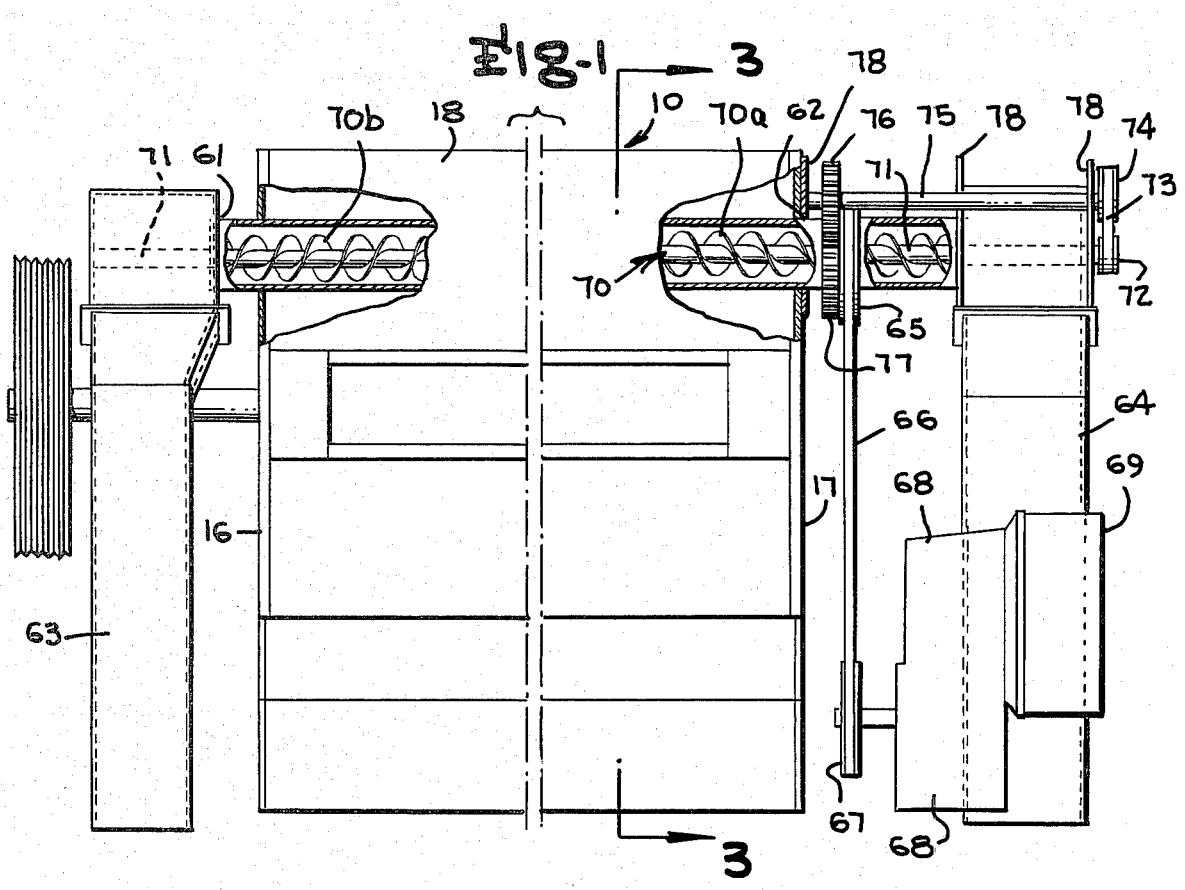
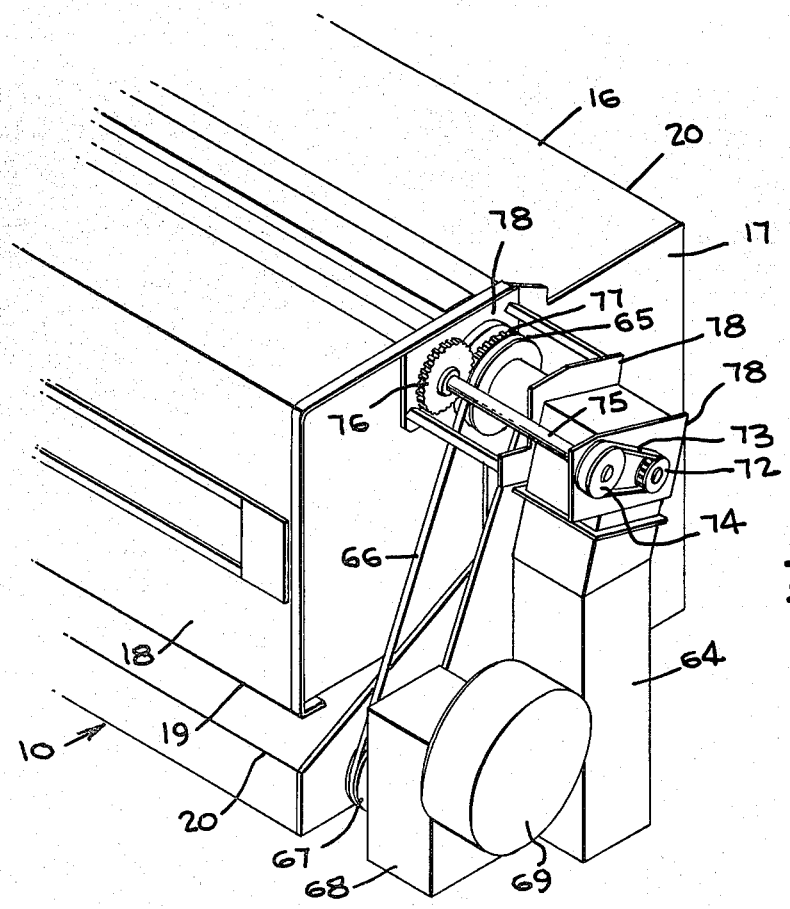
Fig-2

SAW TYPE GIN STAND WITH SEED REMOVAL TUBE

This is a continuation of application Ser. No. 68,101 filed Aug. 20, 1979, now abandoned.

BACKGROUND AND OBJECTS OF THE INVENTION

The present invention relates in general to cotton gins, and more particularly to saw type cotton gins having novel means for removing ginned cotton seed from the roll box in a manner to provide a significant increase in the capacity of cotton gins already having the most advanced known features for providing optimum ginning capacity.

During recent years, the ginning capacity of cotton gins of the saw type has been increased without changing the basic components or fundamental principle of operation of the gins, for example by providing so called larger diameter saw cylinders having saws of about 16-inch diameter driven at high speed, associated with ginning ribs and huller ribs of various designs, whereby greater capacity, for example in the range of 7 to 10 bales per hour, can be realized due to the greater peripheral speed of the saw teeth of such larger diameter saw cylinders and the improved design of the ginning ribs and huller ribs. However, the fundamental elements making up the gin stand were not significantly changed. The ginned seeds were still discharged out the bottom of the gin stand, through the spaces between the saws of the saw cylinder in the region between the ginning ribs and the huller ribs, and thence by gravity feed into the transverse trough in the working zone of the transverse seed conveyor at the bottom of the gin to be conveyed to the disposal location.

It is well recognized that the incoming seed cotton in the feed chute of a conventional saw type gin stand is carried by engagement of the saw teeth with the lint on the seeds into the seed roll in the roll box immediately above the zone between the ginning ribs and the huller ribs where the mix of ginned cotton seeds and unginned cotton is maintained in the form of a relatively compact roll with the perimeter of the seed roll being continuously worked by the saw teeth. The saw teeth engage and pull lint from the seeds in the perimeter of the seed roll through the narrow spaces at the ginning point between the ginning ribs while the seeds are retained in the roll box region by the ginning ribs. The ginned seeds in the seed roll are continuously trying to leave the seed roll and fall through the entrance to the roll box and the seed discharge spaces between the saws of the cylinder in the seed discharge passage zone between the ginning ribs and huller ribs while the saws are trying to bring additional unginned seeds from the feed chute through this same seed passage zone and roll box entrance into the seed roll in the roll box. Thus it has been recognized for many years that the capacity of a gin stand is limited by its inability to discharge the ginned seed with sufficient rapidity from the seed roll in a manner which will reduce seed roll density to desired levels and admit new unginned seed cotton at greater rate to the roll box. The ginned seeds restrained in the seed roll severely limit the ginning capacity because they increase the density of the roll making it difficult for the saw teeth to be fully loaded with lint and the ginned seed trying to get out of the roll box by falling through the roll box entrance where the incoming unginned seed is trying to enter exerts a feed counterforce by fighting the entrance of unginned seed into the roll box.

We have discovered that the capacity of high capacity gin stands of the most advanced design already on the market can be dramatically increased by continuously removing ginned seed from the general area of the midregion of the seed roll in the roll box during the operation of the gin, by providing a driven rotating perforated tube which transversely spans the box and having perforations sized to pass the ginned seeds into the tube for removal by suitable continuously operating conveyor means. By specifically sizing the perforations in the rotating seed removal tube in the roll box to pass the ginned seeds into the hollow center of the rotating tube and conveying these ginned seeds outside of the gin through the tube, thus continuously removing them from the center portion of the seed roll, a predominance of unginned cotton is maintained in the outer peripheral layer of the seed roll to engage the teeth of the saws at the ginning point and markedly increase the ginning capacity, for example up to about 50 percent increase in capacity. This both reduces the density of the seed roll and also reduces the amount of seed trying to get out of the roll box through the entrance region at the top of the zone between the ginning ribs and huller ribs where incoming unginned cotton is trying to enter, thus permitting the teeth of the cylinder saws to be loaded to full capacity.

Efforts have been made in the past to remove "trash or foreign matter" or "hulls or trash" from the roll box of saw type cotton gins of the earlier lower capacity types. Examples of this are found in the Raynor U.S. Pat. No. 2,743,484 providing a fixed perforated tube in the roll box having perforations sized to pass the "trash or foreign material" into the tube for suction withdrawal from the gin stand, or the Olmstead U.S. Pat. No. 26,516 where a driven rotating "cylindrical screen" in the roll box surrounds a revolving "spiral screen" sized to remove "hulls or trash" still attached to cotton in the roll box after passage through the hulling ribs. Jennings U.S. Pat. No. 3,135,021 shows a "rotary rib" type cotton gin wherein a fixed perforated tube is provided so that "dirt can readily get out of the seed roll" and thus produce a "higher grade" of ginned cotton. Also, the Cumpston U.S. Pat. No. 2,149,669 provides a perforated tube in the roll box which is supplied with hot air to assist in drying the cotton and "aid in turning the roll", and the Cotton U.S. Pat. No. 1,341,168 discloses, in a low capacity gin, a perforated fixed tube in the roll box and an inner driven conveyor screw for withdrawing "partially ginned cotton" which is then transferred into a "linter where it is stripped of every particle of merchantable lint". However, we are aware of no prior patents proposing the provision of a driven hollow perforated tube in the central region of the roll box of a saw type gin stand having perforations sized deliberately to pass the ginned cotton seed from the center region of the seed roll into the hollow center portion of the perforated tube where it is conveyed transversely out of the roll box and gin stand to a ginned seed collection facility to thus reduce the density of the seed roll and significantly reduce the quantity of ginned seed leaving the seed roll through the entrance to the roll box where it would continuously counter the introduction of new unginned cotton into the roll box, and by such an arrangement attain significant increases in ginning capacity such as we have realized.

An object of the present invention, therefore, is the provision of a novel saw type gin stand construction of the type having ginning ribs and hulling ribs coacting with a saw cylinder to gin cotton and defining a roll box overlying the zone between the ginning ribs and huller ribs, wherein a rotating perforated tube having openings sized to pass and withdraw ginned seeds from the seed roll is provided along with conveyor means for discharging the withdrawn ginned seeds transversely to a collection facility externally of the roll box, to significantly increase the ginning capacity of saw type gin.

Another object of the present invention is the provision of a novel saw type gin construction of the type described in the immediately preceding paragraph, wherein the perforated hollow tube in the roll box is continuously driven during operation of the gin in an appropriate direction and at an appropriate rate to assist in rotating the seed roll and increase the loading of lint onto the saw teeth to full capacity to optimize the ginning capacity of the gin stand.

Yet another object of the present invention is the provision of a novel arrangement of surface protrusions on the exterior surface of the perforated hollow tube in the roll box of a saw type gin stand as described in the immediately preceding paragraph, further enhancing the capacity increasing properties of the gin stand construction.

Other objects, advantages and capabilities of the present invention will become apparent from the following detailed description, taken in conjunction with the accompanying drawings illustrating a preferred embodiment of the invention.

BRIEF DESCRIPTION OF THE FIGURES

FIG. 1 is a front elevational view, with parts broken away, of a cotton gin constructed in accordance with the present invention;

FIG. 2 is a fragmentary front perspective view of the right-hand side portion of the gin stand of FIG. 1;

DETAILED DESCRIPTION OF A PREFERRED EMBODIMENT

Figure 3:
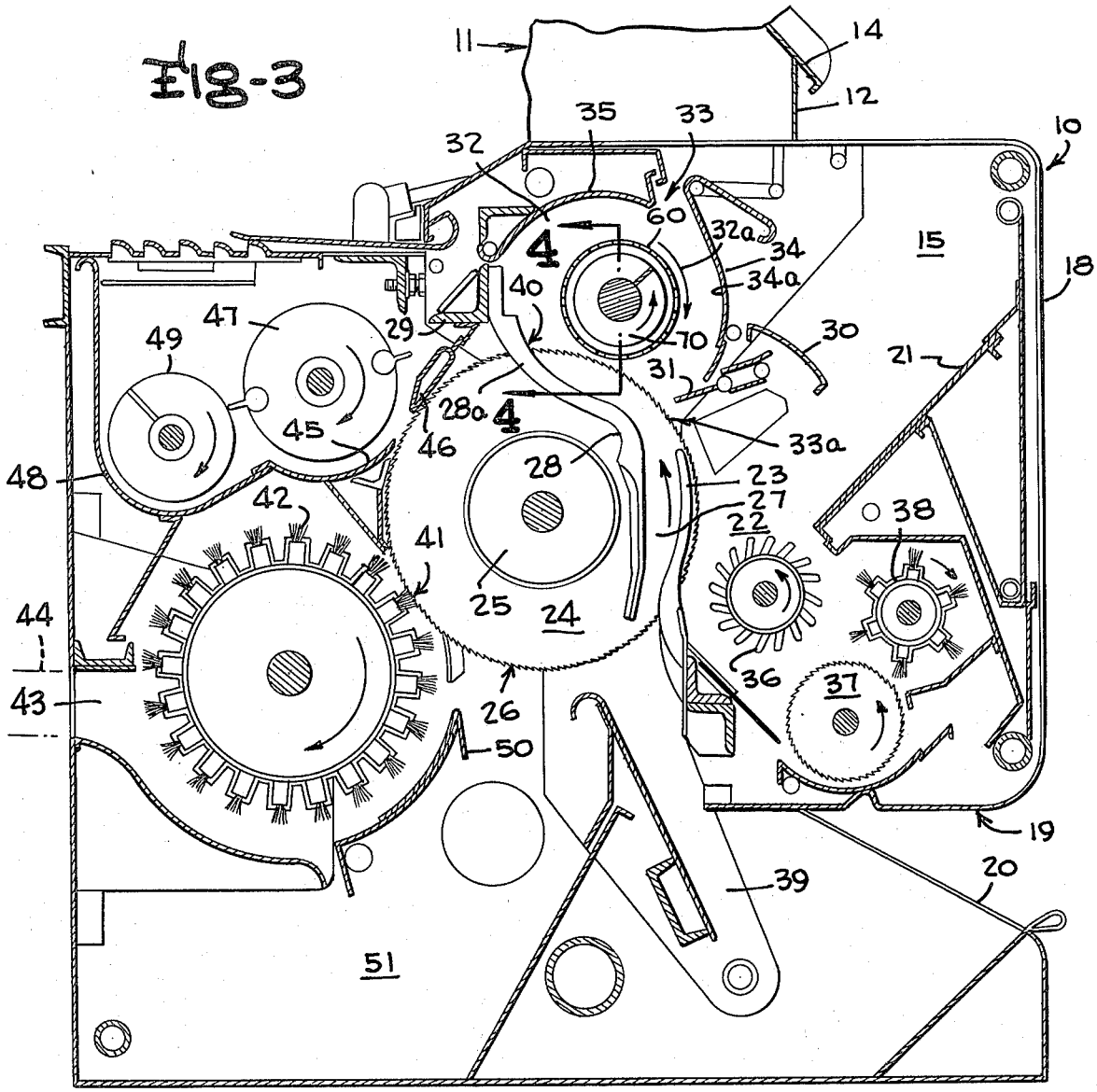
FIG. 3 is a vertical section view of the saw type gin stand, taken substantially along the longitudinal midplane of the gin indicated by the section line 3—3 of FIG. 1, with a conventional extractor feeder surmounted thereon.

Referring to the drawings, wherein like reference characters designate corresponding parts throughout the several figures, there is designated generally by the reference character 10 a cotton gin constructed in accordance with the present invention, which may be preceded by a conventional feeder or extractor-feeder, the lower portion of which is fragmentarily shown in FIG. 3 and indicated by the reference character 11, which in a typical installation receives seed cotton from a conventional distributor after the cotton has been withdrawn from a trailer or wagon by the usual suction intake stack or module feeding means and processed by the usual precleaning equipment such as stick, trash and hulling instrumentalities usually employed to upgrade machine-picked field cotton. The seed cotton feeder 11 may, in accordance with conventional practice, include a housing 12, typically formed of sheet metal and bracing members, having shaped interior sheet metal partitions transversely spanning the width of the feeder and extending through the total height thereof defining a generally vertically extending passage for transfer of the seed cotton from a slide indicated at 14 at the lower outlet of the feeder 11 to the inlet cotton chute 15 of the gin stand 10. The gin stand 10 typically comprises a casing or housing having opposite sides which are substantially flat side plates 16,17, and includes a front plate 18, all lying in generally vertical planes. The side plates 16,17 being interrupted to define a separable front, forwardly movable breast 19 including the supports for hulling ribs and ginning ribs, as later described, permitting the breast structure to be drawn away from the main gin frame 20 for purposes well understood in the trade.

Referring now more particularly to FIG. 3 and the structure of the gin stand 10, the gin includes partition members, for the most part formed of sheet metal, defining the inlet cotton chute 15, to which the cotton is delivered at a controlled rate from the lower discharge end of the feeder 11 and downwardly along the inclined slide or feed chute wall 21 into the loading zone 22 immediately in front of the huller ribs 23 where the lint on the seed cotton is engaged by the teeth of the circular saws 24 which together with spacer blocks 25 make up the saw cylinder 26. Lint on the seed cotton fed into the chute 15 and loading zone 22 is engaged by the teeth of the saws 24 to draw the seeds through the huller ribs 23, which are appropriately shaped and spaced apart appropriate distances such that much of the hull and stick trash intermixed with the seed cotton is restrained against passage between the huller ribs 23 while the unginned cotton seed passes between the huller ribs 23 and into the zone 27, which we term the seed discharge passage zone, between the huller ribs 23 and the ginning ribs 28 fixed to the ribs rail 29 carried by the frame of the gin. A dust shield 30 coacts with the feed chute wall 21 to define the feed chute 15 and overlies an adjustable seed board 31 whose position is set, in accordance with known practices, to assist in properly shaping and guiding portions of the seed roll 32 formed in the roll box 33. The roll box, in accordance with standard practice, is of distorted cylindrical configuration and is basically shaped by the curved upper portions **28*a* of the ginning ribs, the concavely curved portion 34*a* of the roll box door member 34, and the downwardly facing concave partition or sheet member 35** extending over most of top of the roll box.

As is well known, unginned seed cotton fed into the inlet chute 15 and not picked up by the teeth of the saws of the saw cylinder 36 is engaged by the spiked roller 36 and transferred into the zone of action of the teeth of the reclaiming saw 37 which carries the reclaimed unginned cotton seeds around to the doffing point where they are doffed by the reclaiming brush 38 which returns the unginned seeds to the rising or upgoing side of the spiked roller 36 to return the unginned seed cotton to the loading zone 22 to again expose them to be loaded on the teeth of the main saw cylinder 26.

As will be well known to those skilled in the ginning art, the lint ginned from the seeds at the ginning point 40 as it is pulled by the teeth of the main cylinder saws 24 through the spaces between the ginning ribs 28 is carried to the doffing point 41 where it is doffed from the teeth of the saws 26 by the faster moving brushes of the doffing brush 42 and discharged by the air-jet produced by the faster moving bristles of the doffing brush 42 through the doffing outlet 43 into the main lint flue 44 for transferal to the lint cotton cleaners and/or the battery condenser and baling press depending upon the design of the installation.

Typical of current gin stand design, the gin of the illustrated embodiment includes shaped partitions defining an upper moting lip 45 coacting with a mote control board or deflector plate 46 to define a gap through which motes are extracted adjacent the path of the teeth of the main saw cylinder 26 where they are picked up and advanced by the mote wiper 47 into the trough-like formation 48 having the screw conveyor 49 therein, to extract the motes or immature seeds separated out through the opening between the mote control board 46 and upper moting lip 45 and remove them from the gin stand. A lower curved moting lip 50 extends outwardly about a portion of the path of the bristles of the doffing brush 42 to define a zone below the saw cylinder through which motes pass into the lower mote outlet zone 51 for removal in typical manner from the gin stand.

It will be appreciated that in normal conventional operation of the gin, the unginned seed cotton being fed into the inlet cotton chute 15 from the extractor-feeder 11, passes down the inclined feed chute wall 21 between the wall 21 and the dust shield 30 into the loading zone 22 where the lint attached to the seeds on much of the cotton is engaged by the teeth of the saws 24 making up the saw cylinder 26 and are carried upwardly along the convexly curved front surface portions of the huller ribs 23 into the entrance **33*a* of the roll box 33 between the proximal lip of the adjustable seed board 31 and the nearest portion of the ginning ribs 28, to join the mix of partially ginned and unginned cotton forming the seed roll 32 in the roll box 33. The seed roll 32 is revolved in the direction of the arrows 32*a* within the roll box 33 by the action of the saw teeth of the saws 24 on the portion of the seed roll through which the saws project, and lint is progressively drawn or ginned off of the seed at the ginning point 40 by the action of the saw teeth pulling the lint through the spaces between the ginning ribs 28 as the seeds are prevented from passage therethrough. The ginned lint is carried by the saw teeth of the cylinder 26 downwardly to the doffing point 41 where the faster moving bristles or brush formations on the periphery of the doffing brush 42 produce air currents of sufficiently greater relative speed with respect to the adjoining portions of the saw teeth to doff the lint from the saw teeth and carry the same around to the lint cotton outlet 42** where the lint moves through the lint flue to the cleaning instrumentalities or the battery condenser.

As the seeds in the seed roll 32 become substantially free of lint or in a substantially completely "ginned" state, they are of appropriate size and character to attempt to pass gravitationally between the respective circular saws 24 making up the saw cylinder 26, in the region radially outwardly of the spacer blocks 28, in the seed discharge passage zone 27 between the ginning ribs 28 and the huller ribs 23, to fall into the seed discharge chute 39 in the front lower portion of the gin stand, to be picked up by the usual seed discharge screw conveyor and delivered to the discharge point. The ginned seed attempting to pass gravitationally downwardly through the entrance zone **33*a* at the lower front of the roll box 32 are, of course, continuously opposing the movement of new unginned seed cotton upwardly by the saws 24 of the saw cylinder into the roll box through this entrance 33*a*** as the seeds attempting to move downwardly through this entrance region represent a counterflow barrier to entry of the new unginned seed cotton into the roll box.

Transversely spanning the gin stand and located near the center of the roll box 33 but positioned so that its exterior is located near the path of the saw teeth of the cylinder saws 24 is a continuously rotated, perforated ginned seed removal tube 60 which, in the illustrated embodiment, has a 4-inch outer diameter, the rotating seed removal tube 60 being journaled in dust seal bearings 61,62 in the opposite side walls or side plates 16,17 of the gin stand for rotation about the center axis of the seed removal tube 60. The seed removal tube 60 projects beyond both side plates 16,17 of the gin stand and terminates at the opposite ends in bearings in the adjacent walls of seed discharge ducts 63,64 which extend downwardly alongside the sides of the gin stand to connect to a seed discharge conduit system below the gin stand. Rotary drive is imparted to the perforated seed removal tube 60, for example, by providing a pulley 65 fixed on the seed removal tube driven by a belt 66 from a drive pulley 67 extending from a gear reduction box 68 and a drive motor 69 located adjacent the base of the gin stand near the seed discharge duct 64.

A double flite, long pitch, left and right hand screw conveyor 70 is disposed within the rotatable seed removal tube 60 spanning the entire length of the seed removal tube and having the end portions of its center shaft, indicated at 71, journaled in suitable bearings in the upper portions of the seed discharge ducts 63,64. The end of the center shaft 71 extending, for example, through the right-hand seed discharge duct 64 projects beyond the duct 64 to an exposed position and has a belt and pulley drive formed by driven pulley 72, belt 73, and drive pulley 74. The drive pulley 74 is fixed on a shaft 75 having a driven gear 76 engaging a drive gear 77 on the rotating seed removal tube 60, for example fixed to the driven pulley 65, to also impart rotation to the screw conveyor 70. As shown in the drawings, reinforcing or mounting plates 78 may be provided on the side plate 17 of the gin stand and on opposite sides of upper portions of the seed discharge duct 64 to provide appropriate support for the gears and the belt and pulley drive system.

In one satisfactory embodiment, the seed removal tube 60 is of sufficient length to provide a 94-inch axial span inside the gin stand and is a 4-inch outer diameter tube having an inner diameter of 3¾ inches. In this example, the seed removal tube is provided with 24 rows of seed passage holes, indicated by the reference characters 80 in the drawings, which 7/16 inches in diameter and provide a total, in the example, of 2568 holes arranged in a spiral pattern along the tube 60. The screw conveyor 70 extending within the tube has right and left hand flites indicated at **70*a* and 70*b* extending from the center of the portions of the seed removal tube within the gin stand to the open opposite ends of the tube 60 which open into the seed discharge ducts 63,64, each of the flites being spiral flites having an outer diameter of 3¼ inch in the illustrated embodiment. Since the spiral conveyor is centered coaxially relative to the center axis of the seed removal tube 60 within the tube, there is therefore a ¼-inch spacing between the outer edge of the helical vanes or flites 70*a*,70*b* and the inner surface of the tube wall, allowing the seeds which pass through the seed passage openings 80** to fall into the tube inwardly of the inner surface of the tube wall before being contacted by the screw conveyor flites to avoid possible fracture of the seeds or jamming of the mechanism.

In the preferred embodiment, the tube is rotated at a speed so as to produce a surface speed of about 390 ft/min. for a gin in which the surface speed of the outer periphery of the seed roll without such a seed removal tube in the roll box would be about 380 ft/min. For such a seed roll speed (providing the 380 ft/min. surface speed at the periphery of the seed roll) the surface speed for a 4-inch diameter tube located in the roll box at the location of the tube 60 would be about 137 ft/min. Thus the surface speed of about 390 ft/min. for the 4-inch seed removing tube 60 is just slightly under three times the calculated surface speed at the 4-inch diameter region of the seed roll for the 380 ft/min. seed roll periphery surface speed. The screw conveyor 70 within the rotating tube 60 was run at a speed of about 600 rpm for the illustrated example, which is slightly over four times the speed of the rotating perforated tube 60. Ginning capacity tests have been conducted over a wide range of perforated tube surface speeds, running as low as about 150 ft/min. surface speed for the tube and increasing to over 400 ft/min. for the perforated tube, with the result that optimum capacities were achieved at about 390 ft/min. and no increase in capacity was observed for surface speeds higher than this figure in these tests.

Satisfactory results have also been experienced with a 5-inch outer diameter perforated seed removing tube for the tube 60, with about 1712 holes of 7/16 inch diameter formed in the tube in a spiral pattern, and the tube rotated also at about 390 ft/min. surface speed. The calculated surface speed for a 5-inch diameter center portion of a seed roll whose periphery has a surface speed of 380 ft/min. without the center tube would be about 173 ft/min., so that the 390 ft/min. surface speed for the tube is still more than twice such calculated surface speed for the 5-inch seed roll portion. In the 5-inch tube example, the conveyor flites provided a 4-inch outer diameter, again providing adequate space between the inner surface of the tube 60 and the outer edge of the flite for the seed to completely enter the tube before being contacted by the flites of the screw conveyor.

Figure 4:
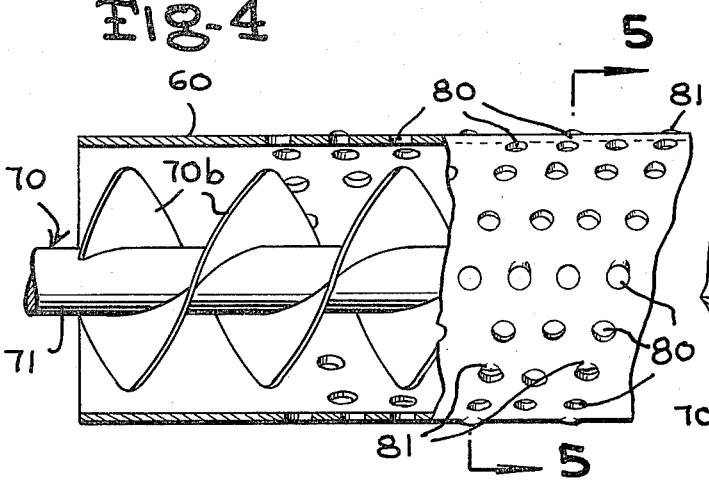
FIG. 4 is a fragmentary section view, to enlarged scale, through the perforated roll box tube and conveyor screw assembly, taken the line 4—4 of FIG. 3, with portions of the tube broken away.
Figure 5:
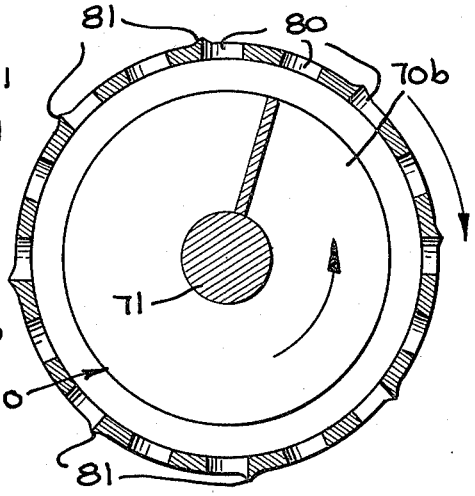
FIG. 5 is a fragmentary vertical section view taken along the line 5—5 of FIG. 4.

Although significant increases in ginning capacity are attained by the above construction using a perforated rotating seed removal tube which is merely drilled to provide the 7/16-inch holes 80 without any distortion of the exterior or outer surface of the tube 60, in the preferred embodiment ⅓ of the holes 60 are provided with outwardly extending upset protrusions, indicated at 81 in FIGS. 4 and 5, along the trailing edge portions of the holes, defining crescent-shaped slightly raised convex shoulders along most of the trailing edge of each of the holes 80 provided with the upset protrusions or shoulder formations 81. In the illustrated embodiment, 856 of the 2568 holes 80 are upset along their trailing edge portions providing the protrusions or shoulders 81. While provision of projections along the surface of the tube 60 in areas between the holes, such as pins extending outwardly short distances at discrete locations or ribs extending transversely along paths paralleling the axis of the tube, would seem theoretically to be useful in assisting the tube to impart rotation to the inner regions of the seed roll, these alternatives are unsatisfactory. The transverse ribs prove disadvantageous as they tend to keep the ginned seeds away from the holes in the tube and thus do not enable adequate quantities of the ginned seeds to reach and be removed from the center region of the seed roll, and the provision of pins on the tube surface tended to lump up the cotton and prevent proper passage of seeds into the tube for removal from the seed roll. By providing the upstruck or upset convex shoulder forming protrusions 81 along the trailing edges of the seed holes 80 in the tube 60, rotation arising from the relatively greater surface speed of the tube 80 compared to the adjacent portions of the seed roll is more effectively imparted to the seed roll assisting loading of lint onto the teeth of the ginning saws 24 to their maximum capacity, and effective withdrawal of the ginned seeds through the holes 80 into the hollow center of the tube 60 for removal by the screw conveyor 70 is accomplished, reducing the density of the seed roll and diminishing the counterflow resistance presented by ginned seeds attempting to fall through the entrance to the roll box 33 at the top of the seed discharge passage zone 27 between the ginning and huller ribs resisting inflow of new unginned seed cotton upwardly through the roll box entrance to be presented to the ginning point 40. By the present arrangement, approximately 40 percent of the seed discharged from the gin stand is through the perforated rotating seed removal tube 60, resulting in attainment of improvements in ginning capacity of close to 50 percent above normal standard high capacity gin stand capacities of about 7½ bales per/hr. under normal operating conditions for standard gins and up to about 10 bales per/hr. for standard gin stands operating under best conditions.

We claim:

1. A saw type cotton gin and auxiliary seed discharge means designed to have high capacity through continuous removal of ginned seed axially from the interior portion of the seed roll during ginning concurrently with gravity discharge of ginned seeds from the seed roll periphery, comprising a gin stand casing having ginning ribs and hulling ribs therein spaced from the ginning ribs and a saw cylinder having saws rotating about a saw cylinder axis and extending through said ribs, means defining a roll box located generally above the intervening zone between the ginning and hulling ribs having an entrance at the top of said intervening zone to receive seed cotton carried through the hulling ribs and upwardly into the roll box to join cotton in the seed roll and be presented to ginning points between said ginning ribs, the saws including toothed edge portions extending into the roll box and said seed roll being rotated thereby about an axis paralleling the saw cylinder axis, a gravity seed discharge from the roll box through said intervening zone, a rotatable perforated seed removal tube located in the roll box at the interior portion of the seed roll near the axis of rotation of the seed roll paralleling said axis and spanning the width of the roll box and gin stand casing, the tube having many perforations through the tube wall thereof sized to pass ginned seeds therethrough into its interior while preventing passage of unginned seeds, means for continuously rotating said seed removal tube about its axis in direction corresponding to the direction of seed roll rotation and at a surface speed significantly exceeding the speed imparted to the immediately confronting seed roll portions by the saws, said tube including a plurality of shallow protrusions extending outwardly from the outer surface of the tube immediately adjacent trailing edge portions only of a predetermined portion of the perforations therein to enhance imparting of rotation to the seed roll from the tube, screw conveyor means within said tube spanning its length and means for rotating the screw conveyor means to convey the ginned seeds passing into the tube through its perforations outwardly through end portions of the tube to external seed receiving means whereby a significant proportion of ginned seeds are removed from the interior of the seed roll greatly diminishing the proportion of ginned seed gravity discharge through said intervening zone and thereby significantly diminishing counterflow resistance to transport of unginned seeds upwardly through said zone and into the roll box.

2. A saw type cotton gin as defined in claim 1, wherein said screw conveyor means includes a center shaft and a spiral van flite structure extending from the shaft whose edges are spaced inwardly from the inner surface of the tube wall approximately the diameter of the ginned seed to accommodate passage of ginned seeds fully through said perforations into the tube before engagement of the flite structure.

3. A saw type cotton gin as defined in claim 2, wherein said means for rotating the seed removal tube drives the tube at a surface speed in the range of about three to four times the speed the portion of the seed roll occupied by the tube would have when driven by the saws alone without the tube being present.

4. A saw type cotton gin as defined in claim 2, wherein the seed removal tube is about four inches in diameter for a nominal eleven inch diameter seed roll and is driven at a surface speed of about 390 ft. per minute.

5. A saw type cotton gin as defined in claim 4, wherein said protrusions are integral outwardly pointed upstruck shoulder formations along the trailing edge portions of at least about one-third of said perforations in said tube defining outwardly convex arcuate sharp edges at said trailing edges when viewed in front elevation.

6. A saw type cotton gin as defined in claim 2, wherein the seed removal tube is about five inches in diameter for a nominal eleven inch diameter seed roll and is driven at a surface speed of about 390 ft. per minute.

7. A saw type cotton gin as defined in claim 6, wherein said protrusions are integral outwardly pointed upstruck shoulder formations along the trailing edge portions of said perforations in said tube defining outwardly convex arcuate sharp edges at said trailing edges when viewed in front elevation.

8. A saw type cotton gin as defined in claim 2, wherein said protrusions are integral outwardly pointed upstruck shoulder formations along the trailing edge portions of said perforations in said tube defining outwardly convex arcuate sharp edges at said trailing edges when viewed in front elevation.

9. A saw type cotton gin as defined in claim 1, wherein said means for rotating the seed removal tube drives the tube at a surface speed in the range of about three to four times the speed the portion of the seed roll occupied by the tube would have when driven by the saws alone without the tube being present.

10. A saw type cotton gin as defined in claim 9, wherein said protrusions are integral outwardly pointed upstruck shoulder formations along the trailing edge portions of said perforations in said tube defining outwardly convex arcuate sharp edges at said trailing edges when viewed in front elevation .

11. A saw type cotton gin as defined in claim 1, wherein the seed removal tube is about four inches in diameter for a nominal eleven inch diameter seed roll and is driven at a surface speed of about 390 ft. per minute.

12. A saw type cotton gin as defined in claim 11, wherein said protrusions are integral outwardly pointed upstruck shoulder formations along the trailing edge portions of at least about one-third of said perforations in said tube defining outwardly convex arcuate sharp edges at said trailing edges when viewed in front elevation.

13. A saw type cotton gin as defined in claim 1, wherein the seed removal tube is about five inches in diameter for a nominal eleven inch diameter seed roll and is driven at a surface speed of about 390 ft. per minute.

14. A saw type cotton gin as defined in claim 1, wherein said protrusions are integral outwardly pointed upstruck shoulder formations along the trailing edge portions of said perforations in said tube defining outwardly convex arcuate sharp edges at said trailing edges when viewed in front elevation.

* * * * *